US006581347B1

(12) United States Patent
Knak et al.

(10) Patent No.: US 6,581,347 B1
(45) Date of Patent: Jun. 24, 2003

(54) EXPANSION JOINT COVER

(75) Inventors: Ronny L. Knak, Wichita, KS (US); Dean V. Balocca, Wichita, KS (US); Johnnie D. Hilburn, Jr., Wichita, KS (US)

(73) Assignee: Balco, Inc., Wichita, KS (US)

( * ) Notice: Subject to any disclaimer, the term of this patent is extended or adjusted under 35 U.S.C. 154(b) by 0 days.

(21) Appl. No.: 10/078,079

(22) Filed: Feb. 15, 2002

(51) Int. Cl.[7] ..... E04B 1/68; E04I 15/14

(52) U.S. Cl. ..... 52/396.04; 52/396.08; 52/396.09; 52/464; 52/468; 52/471; 52/573.1; 404/58

(58) Field of Search ..... 52/396.04, 396.05, 52/396.08, 396.09, 402, 463, 464, 468, 471, 573.1; 404/47, 52, 54, 57, 58, 69, 70

(56) References Cited

U.S. PATENT DOCUMENTS

| | | | | | |
|---|---|---|---|---|---|
| 3,371,456 | A | * | 3/1968 | Balzer et al. | |
| 3,417,528 | A | * | 12/1968 | Hallock | |
| 3,659,390 | A | * | 5/1972 | Balzer et al. | 52/464 |
| 3,750,359 | A | * | 8/1973 | Balzer et al. | 52/468 |
| 3,864,886 | A | | 2/1975 | Thom | |
| 4,073,673 | A | * | 2/1978 | Raabe et al. | 156/244 |
| 4,271,650 | A | * | 6/1981 | Lynn-Jones | 52/395 |
| 4,611,449 | A | | 9/1986 | Wilson et al. | |
| 4,893,448 | A | * | 1/1990 | McCormick | 52/396 |
| 4,914,884 | A | * | 4/1990 | Ohmatsu | 52/396 |
| 4,923,328 | A | * | 5/1990 | Arps et al. | 404/69 |
| 4,956,955 | A | | 9/1990 | Ohmatsu | |
| 5,060,439 | A | | 10/1991 | Clements et al. | |
| 5,067,297 | A | | 11/1991 | Sobol | |
| 5,082,394 | A | * | 1/1992 | George | 404/68 |
| 5,092,094 | A | * | 3/1992 | Duda et al. | 52/573 |
| 5,184,442 | A | | 2/1993 | Maxwell, Jr. et al. | |
| 5,259,162 | A | | 11/1993 | Nicholas | |
| 5,319,907 | A | | 6/1994 | Nicholas et al. | |
| 5,357,727 | A | | 10/1994 | Duckworth et al. | |
| 5,384,996 | A | | 1/1995 | Nicholas | |
| 5,887,400 | A | * | 3/1999 | Bratek et al. | 52/396.03 |
| 6,014,848 | A | | 1/2000 | Hilburn, Jr. | |
| 6,115,980 | A | | 9/2000 | Knak et al. | |

* cited by examiner

*Primary Examiner*—Carl D. Friedman
*Assistant Examiner*—Yvonne M. Horton
(74) *Attorney, Agent, or Firm*—Hovey Williams LLP

(57) ABSTRACT

An expansion joint cover (10) comprises a first plate (18) hingedly attached to a first surface (14) of an expansion joint (12), a second plate (20) hingedly attached to the first plate (18), and a housing (26) fixedly secured to a second surface (16) of the expansion joint (12). During installation, a front plate (52) of the housing (26) can rotate about a hinge (58) to allow the second plate (20) to be installed within the housing (26). In use, the second plate (20) slides within the housing (26) to accommodate variations in separation distance and vertical offset between the two surfaces (14,16). Two hinges (36,44) accommodate variations in torsion between the two surfaces (14,16). The combination of the second plate (20) sliding within the housing (26) and the two hinges (36,44) accommodates variations in lateral offset between the two surfaces (14,16).

18 Claims, 4 Drawing Sheets

EXPANSION JOINT COVER

BACKGROUND OF THE INVENTION

1. Field of the Invention

The present invention relates to expansion joints and expansion joint covers. More particularly, the present invention relates to an expansion joint cover that can accommodate variations in separation distance, vertical offset, lateral offset, and torsion between two surfaces of an expansion joint.

2. Description of Prior Art

Buildings are typically constructed of rigid materials such as concrete and steel which are chosen for their ability to support loads and resist movement under those loads. Unfortunately, such rigid materials sometimes experience failures when they expand or contract due to changing temperatures or when they move due to seismic events.

To prevent failures, it is common practice to build expansion joints into buildings. Expansion joints are essentially gaps between two rigid surfaces of a building which allow the two surfaces to move with respect to each other without the failures described above.

Typically, an expansion joint is either filled, covered, or both. An expansion joint can be filled with a flexible material with desired characteristics such that it is, for example, waterproof and/or fire resistant. While the flexible material may effectively seal the expansion joint, it is typically not aesthetically appealing and therefore is often covered.

There are several expansion joint cover designs in the prior art. Some cover designs incorporate a plate which is secured to one of two surfaces to span an expansion joint between the two surfaces. An end of the plate typically slides against the other surface in order to accommodate variations in separation distance and vertical offset. These designs cannot effectively accommodate variations in lateral offset and torsion between the two surfaces.

Another design includes a plate that slides within at least one housing. The housing is secured to one of two surfaces of an expansion joint. The plate is secured to the other surface. The plate slides within the housing in order to accommodate variations in separation distance. However, the internal dimensions of the housing limit the allowable lateral offset and torsion between the two surfaces.

An improved design includes a plate with a first end connected to one of two surfaces of an expansion joint by a hinge. A second end of the plate slides within a housing, which is fixedly mounted to the other surface. The plate is thus able to accommodate variations in separation distance between the two surfaces. The hinge is able to accommodate variations in torsion between the two surfaces. However, the internal dimensions of the housing still limit allowable lateral offset between the two surfaces.

Accordingly, there is a need for an expansion joint cover that overcomes the limitations of the prior art. Specifically, there is a need for an expansion joint cover that can accommodate variations in separation distance, vertical offset, lateral offset, and torsion between two surfaces of an expansion joint.

SUMMARY OF THE INVENTION

The expansion joint cover of the present invention overcomes the above-identified problems and provides a distinct advance in the art of expansion joints. More particularly the present invention provides an expansion joint cover that can accommodate variations in separation distance, vertical offset, lateral offset, and torsion between two surfaces of an expansion joint.

The expansion joint cover is preferably used to cover an expansion joint comprising a first surface and a second surface. The preferred embodiment of the expansion joint cover broadly comprises a first plate, a second plate, a first hinge assembly hingedly attaching the first plate to the first surface, a second hinge assembly hingedly attaching the first plate to the second plate, and a housing fixedly secured to the second surface. The first plate includes an exterior surface, where a facade can be secured, in order to enhance aesthetic appeal of the expansion joint cover.

The second plate similarly includes an exterior surface, where a facade can be secured. The second plate also includes a positioner secured to an internal end. The positioner includes two low-friction seals that allow the internal end to slide within the housing.

The first hinge assembly and the second hinge assembly are similar and both include a hinge and a face seal. The face seal is flexible and covers the hinge in an aesthetically appealing manner.

The housing includes a front plate, a rear plate, a tension block, a hinge, and a face seal. During installation, the front plate can rotate about the hinge to allow the second plate to be installed within the housing. The front plate includes a front standoff and a low friction seal that seals the front plate to the facade of the second plate. The rear plate similarly includes a rear standoff and a low friction seal that seals the rear plate to the second plate. The face seal is flexible and covers the hinge in an aesthetically appealing manner.

An installer installs the expansion joint cover by first mounting the first hinge assembly to the first surface and the rear plate to the second surface. Then, the installer mounts the facade to the first and second plates and places the second plate within the housing. Then, the installer secures the front plate against the second plate by driving a tension bolt through the front plate and into the tension block. Finally, the installer mounts the facade to the front plate.

Alternatively, the housing may include only a front plate, a rear plate, and a bracket. The front plate and the rear plate would include the standoffs and low friction seals discussed above. The bracket may be a separate component that is attached, affixed, or integral to the rear plate. The front plate is secured to the bracket using mechanical fasteners, adhesives, tapes, and/or welds. This would negate the need for the tension block, the hinge, and the face seal.

In use, the second plate slides within the housing to accommodate variations in separation distance and vertical offset between the two surfaces. The two hinge assemblies accommodate variations in torsion between the two surfaces. The combination of the second plate sliding within the housing and the two hinge assemblies accommodates variations in lateral offset between the two surfaces.

BRIEF DESCRIPTION OF THE DRAWINGS

A preferred embodiment of the present invention is described in detail below with reference to the attached drawing figures, wherein.

DETAILED DESCRIPTION OF A PREFERRED EMBODIMENT

Figure 1:
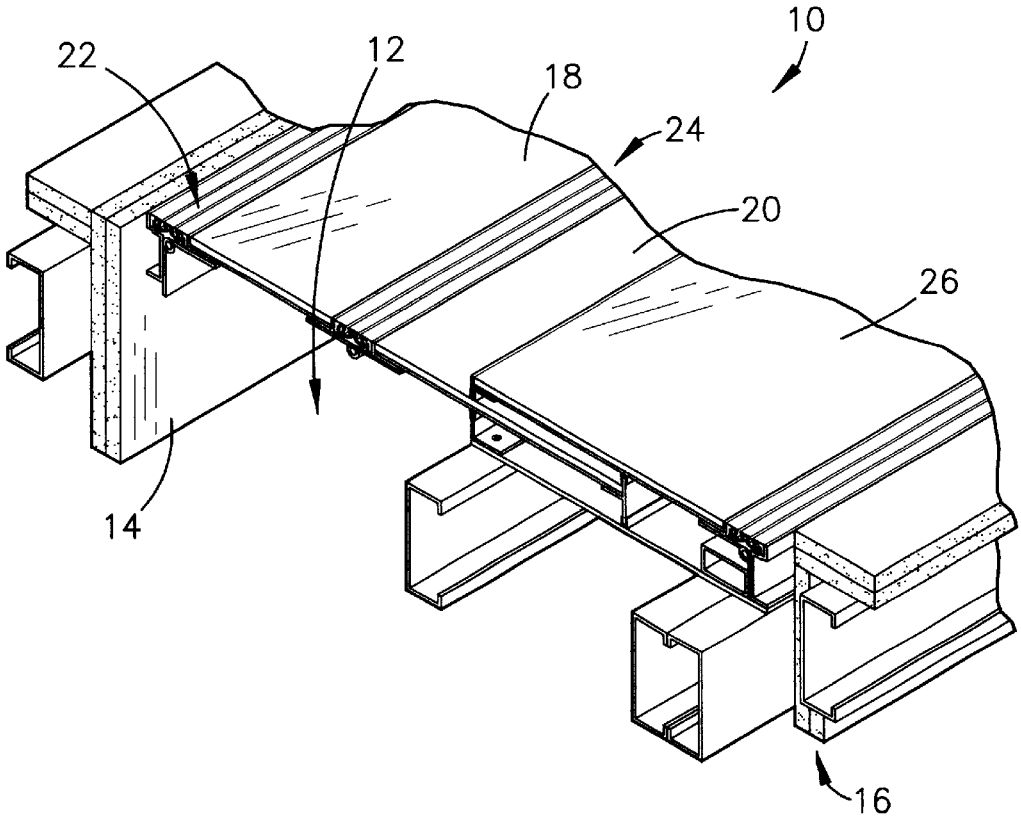
FIG. 1 is a perspective view of an expansion joint cover constructed in accordance with a preferred embodiment of the present invention and shown covering an expansion joint.

Referring to FIG. 1, an expansion joint cover 10 is shown constructed in accordance with a preferred embodiment of the present invention. The cover 10 is used to cover an expansion joint 12 between a first surface 14 and a second surface 16 of a building or other structure. The surfaces 14, 16 can have similar or different configurations and textures and may be parallel, perpendicular, or otherwise situated relative to each other.

Figure 2:
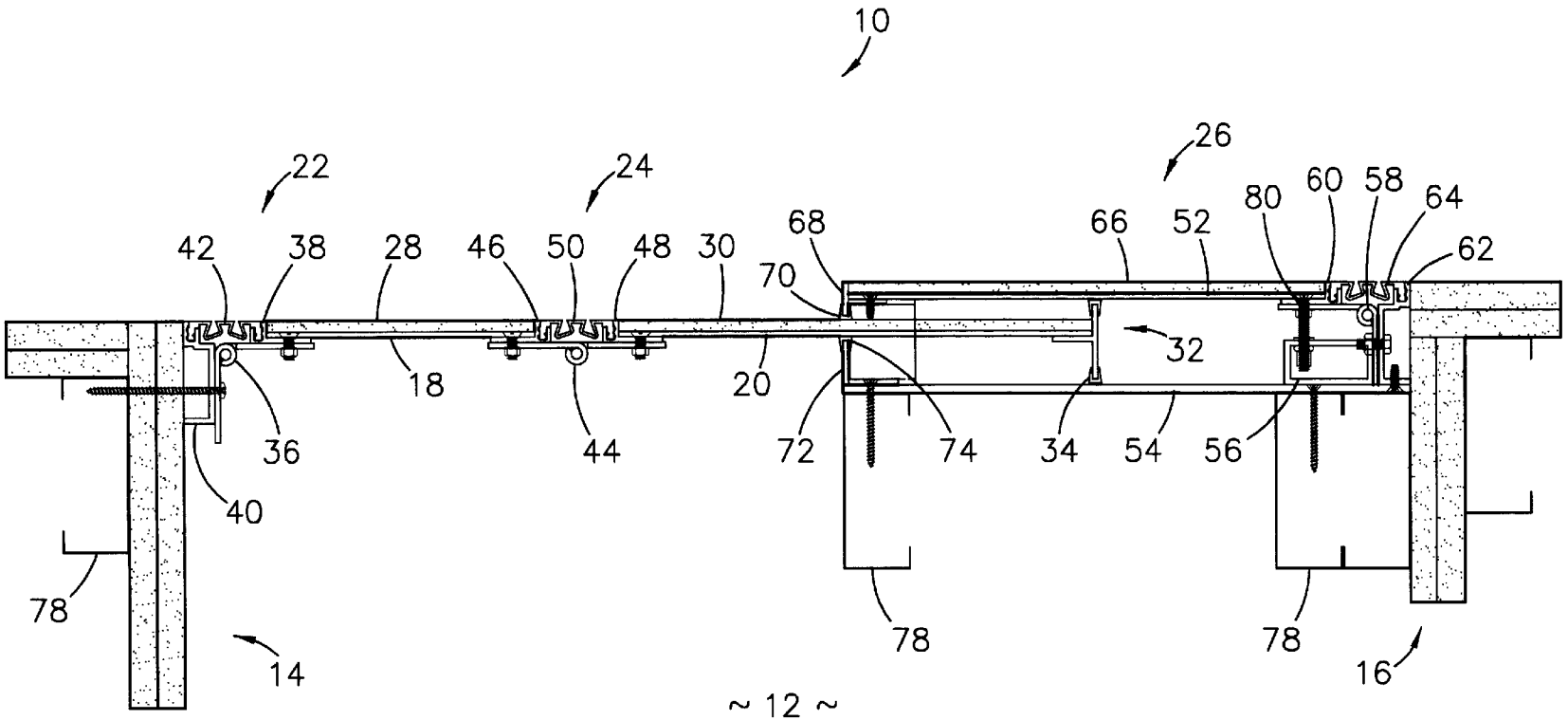
FIG. 2 is a plan view of the expansion joint cover.

Referring also to FIG. 2, the preferred expansion joint cover 10 broadly comprises a first plate 18, a second plate 20, a first hinge assembly 22 hingedly attaching the first plate 18 to the first surface 14, a second hinge assembly 24 hingedly attaching the first plate 18 to the second plate 20, and a housing 26 fixedly secured to the second surface 16. The first plate 18 is preferably constructed of steel, but can be constructed of any rigid material. The first plate 18 includes an exterior surface, where a facade 28 can be secured, in order to enhance aesthetic appeal of the cover 10. The facade 28 can be any finish material, such as, gypsum wall board, plastic wall covering, masonite, or other wall finish materials.

The second plate 20 is similar to the first plate 18 and is preferably constructed of steel, but can be constructed of any rigid material. The second plate 20 also includes an exterior surface, where a facade 30 can be secured. The facade 30 is preferably identical to the facade 28 of the first plate 18. The second plate 20 also includes a positioner 32 secured to an internal end. The positioner 32 includes two low-friction gaskets 34 that reduce friction and noise as the second plate 20 slides within the housing 26.

The first hinge assembly 22 includes a hinge 36, a plate bracket 38 between the first plate 18 and the hinge 36, a surface bracket 40 between the first surface 14 and the hinge 36, and a face seal 42 sealing between the two brackets 38,40. The hinge 36 is preferably a traditional metal hinge with two hinge plates and a hinge pin. The plate bracket 38 is secured between the first plate 18 and the hinge 36 using mechanical fasteners, adhesives, tapes, and/or welds. The surface bracket 40 is secured between the first surface 14 and the hinge 36 using mechanical fasteners, adhesives, tapes, and/or welds. The face seal 42 is preferably constructed of rubber or foam, but can be constructed of any flexible material. The face seal 42 covers the hinge 36 in an aesthetically appealing manner.

The second hinge assembly 24 is similar to the first hinge assembly 22 and includes a hinge 44, a first plate bracket 46 between the first plate 18 and the hinge 44, a second plate bracket 48 between the second plate 20 and the hinge 44, and a face seal 50 sealing between the two brackets 46,48. The hinge 44 is preferably identical to the hinge 36 of the first spring assembly 22. The brackets 46,48 are secured between the hinge 44 and the plates 18,20 using mechanical fasteners, adhesives, tapes, and/or welds. The face seal 42 is preferably identical to the face seal 42 of the first hinge assembly 22.

The housing 26 includes a front plate 52, a rear plate 54, a tension block 56, a hinge 58, a plate bracket 60 between the front plate 52 and the hinge 58, a surface bracket 62 between the second surface 16 and the hinge 58, and a face seal 64 sealing between the two brackets 60,62. The front plate 52 is similar to the first plate 18 and is preferably constructed of steel, but can be constructed of any rigid material. The front plate 52 also includes an exterior surface, where a facade 66 can be secured. The facade 66 is preferably identical to the facade 28 of the first plate 18. During installation, the front plate 52 can rotate about the hinge 58 to allow the second plate 20 to be installed within the housing 26. The front plate 52 includes a front standoff 68 and a low friction gasket 70 that seals the front plate 52 to the facade 30 of the second plate 20.

The rear plate 54 similarly includes a rear standoff 72 and a low friction gasket 74 that seals the rear plate 54 to the second plate 20. The tension block 56 is secured to the rear plate 54 using mechanical fasteners, adhesives, tapes, and/or welds. The hinge 58 is preferably identical to the hinge 36 of the first hinge assembly 22. However, the hinge 58 may also be a spring hinge, which may aid installation by holding the front plate 52 open or which may aid performance by holding the front plate 52 closed. The brackets 60,62, and the face seal 64 are preferably identical to the brackets 38,40 and the face seal 42 of the first hinge assembly 22. The rear plate 54 and/or the surface bracket 62 is fixedly secured to the second surface 16 using mechanical fasteners, adhesives, tapes, and/or welds.

The low friction gaskets 34,70,74 may be individual components or may be simply a low friction coating. Furthermore, they may or may not be identical. For instance, it can be seen that the gaskets 34 on the positioner 32 and the gasket 74 on the rear standoff 72 are in contact with either the second plate 20, the front plate 52, or the rear plate 54. Therefore, those gaskets 34,74 need to be able to provide reduced friction and noise while sliding along those plates 20,52,54. As those plates 20,52,54 are separate items, they may be constructed of different materials and therefore may require different characteristics of their respective gaskets 34,74.

Additionally, the gasket 70 is in contact with the facade 30 of the second plate 20. Therefore, the gasket 70 must be able to provide reduced friction and noise while sliding along the facade 30 without damaging the facade 30.

Figure 3:
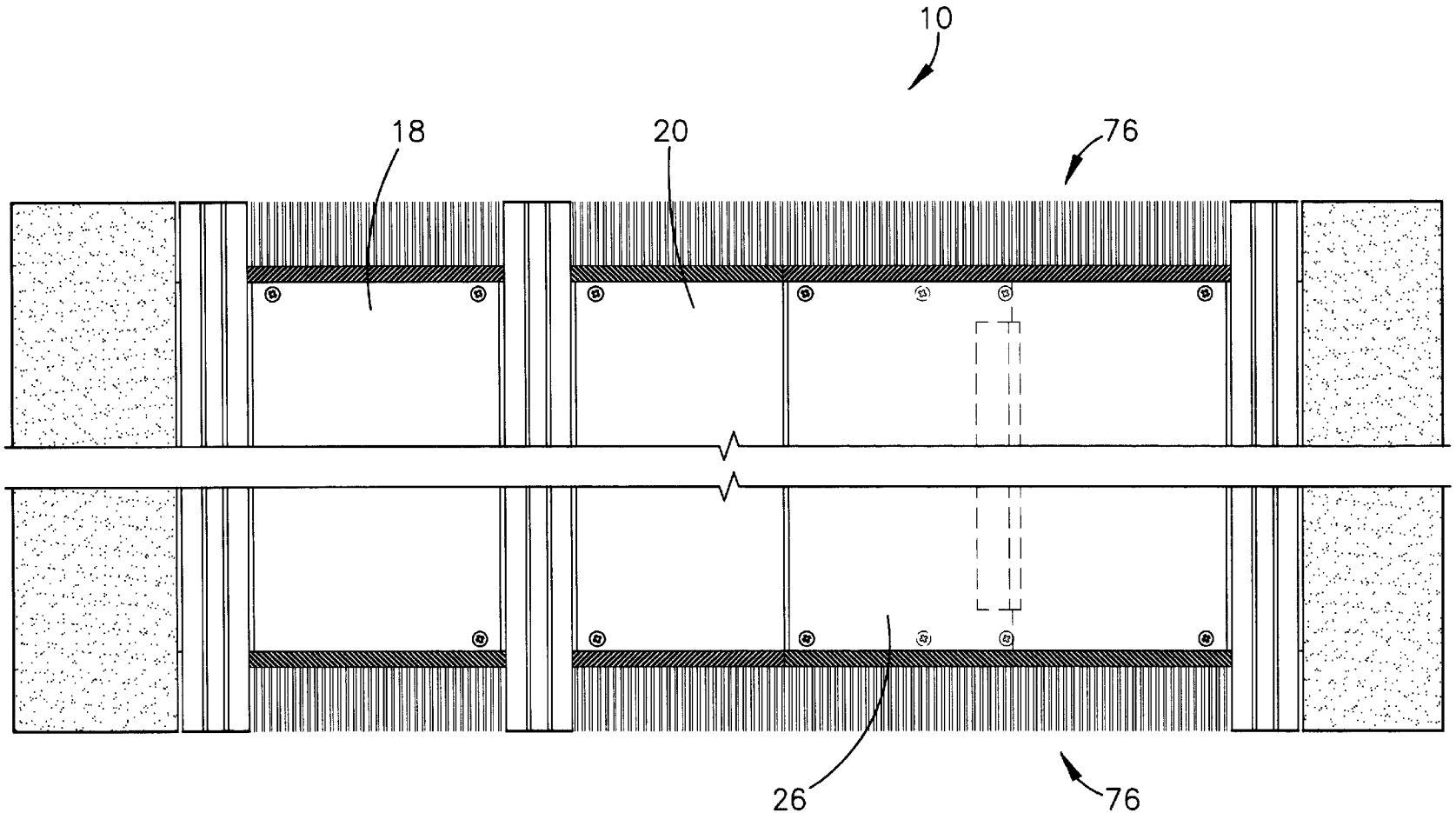
FIG. 3 is an elevation view showing optional sweep strips at each edge of the expansion joint cover.

Also referring to FIG. 3, the first plate 18, the second plate 20, and the housing 26 are preferably each provided with sweep strips 76 at each edge. The sweep strips 76 are designed to allow the cover 10 to slide past an adjacent wall, a floor, or a ceiling while the two surfaces 14,16 move relative to one another. Each sweep strip 76 may be constructed of brushes, fabric, elastomers, some other suitable material, or a combination of such materials. Each sweep strip 76 may be attached to the cover 10 using mechanical fasteners, adhesives, tapes, and/or welds.

Alternatively, caps may be used in place of the sweep strips 76. The caps may be used at the wall, the floor, or the ceiling to allow the cover 10 to slide behind them without producing visible gaps.

An installer installs the cover 10 by first mounting the first hinge assembly 22 to the first surface 14 and the rear plate 54 to the second surface 16 using mechanical fasteners, adhesives, tapes, and/or welds. The installer can either mount the first hinge assembly 22 and the rear plate 54 to the first surface 14 and second surface 16 respectively, directly or indirectly, using one or more supports 78 or other attachment components. The supports 78 may be used to support the weight of the cover 10 or may be used to ensure better alignment of the cover 10.

Next, the installer mounts the facade 28 to the first plate 18 and the facade 30 to the second plate 20. The installer then places the second plate 20 within the housing 26. With the second plate 22 in the housing 26, the installer secures the front plate 52 against the facade 30 by driving a tension bolt 80 through the front plate 52 and into the tension block 56. Finally, the installer mounts the facade 66 to the front plate 52.

Figure 4:
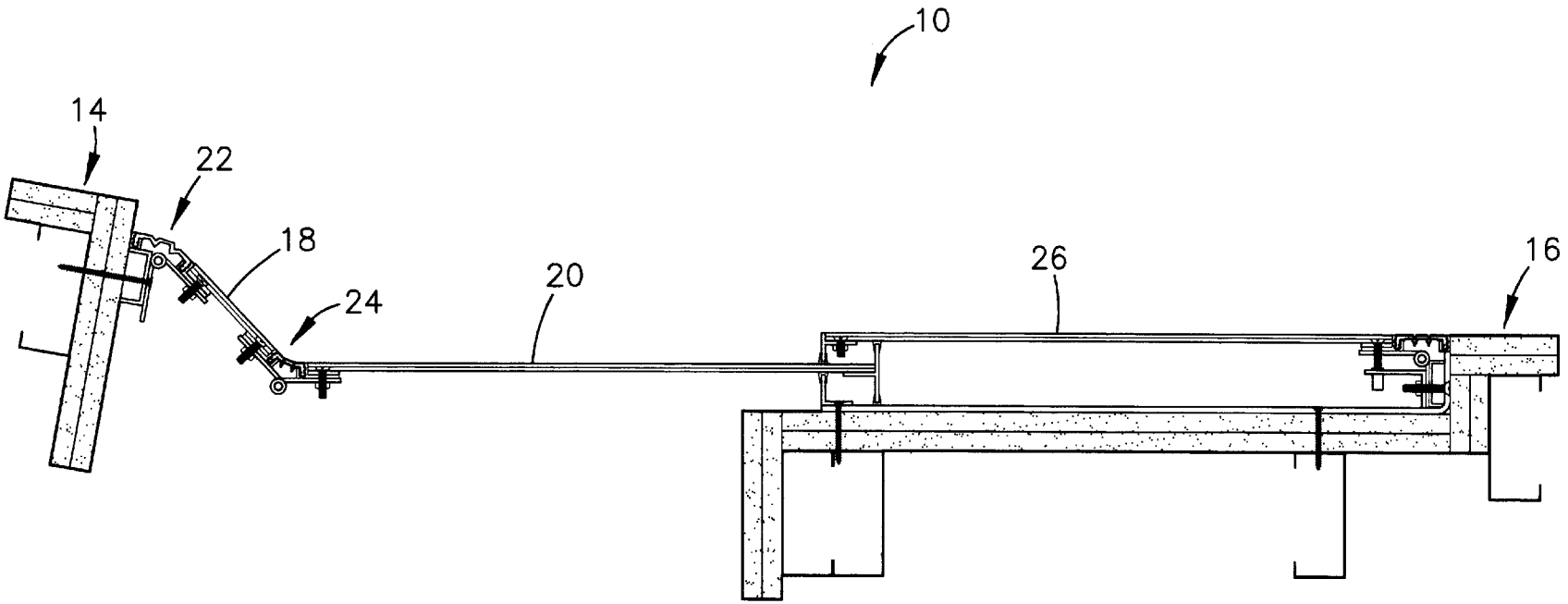
FIG. 4 is the view of FIG. 2, showing the expansion joint cover accommodating variations in separation distance, lateral offset, and torsion between two surfaces of the expansion joint.

In use, as shown in FIG. 4, the second plate 20 slides within the housing 26 to accommodate variations in separation distance and vertical offset between the two surfaces 14,16. The two hinge assemblies 22,24 accommodate variations in torsion between the two surfaces 14,16. The combination of the second plate 20 sliding within the housing 26 and the two hinge assemblies 22,24 accommodates variations in lateral offset between the two surfaces 14,16.

While the preferred embodiment of the present invention has been described above, it is understood that other materials can be substituted. Additionally, items which have been described as preferably identical to another item may have differences, as a matter of design choice. These and other minor modifications are within the scope of the present invention.

Furthermore, dimensions are a matter of design choice. The cover 10 can be designed to accommodate any expansion joint 12. The dimensions of the first plate 18, the second plate 20, and the housing 26 are dependant upon the dimensions of the expansion joint 12 itself and the expected variations in separation distance, lateral offset, and torsion between the two surfaces 14,16.

For instance, the width of the first plate 18 is dependant upon the expected variations in lateral offset. As can be seen, the maximum lateral offset is directly proportional to the length of the first plate 18.

A contemplated embodiment comprises the hinges 36,44,58 being integral to one or more of the plates 18,20,52,54, one or more of the brackets 38,40,46,48,60,62, or an attachment mechanism. Alternatively, the hinges 36,44,58 could be affixed directly to the respective plates 18,20,52,54 using mechanical fasteners, adhesives, tapes, and/or welds.

Another contemplated embodiment comprises the hinges 36,44,58 being constructed of other materials. The hinges 36,44,58 discussed above are traditional metal hinges each with two hinge plates and a hinge pin. An alternative would be to use elastomers, fabrics, laminates, or composite materials as the hinges 36,44,58. Additionally, the hinges 36,44,58 might not need to be covered, thus negating the need for the face seals 42,50,64.

Another contemplated embodiment comprises the housing 26 consisting of the front plate 52, the rear plate 54, and a bracket. The front plate 52 and the rear plate 54 would include the standoffs 68,72 and the low friction seals 70,74 discussed above. The bracket may be a separate component that is attached, affixed, or integral to the rear plate 54. After the second plate 20 is placed within the housing 26, the front plate 52 is secured to the bracket and the facade 66 is mounted to the front plate 52.

Having thus described a preferred embodiment of the invention, what is claimed as new and desired to be protected by Letters Patent includes the following:

1. An expansion joint cover for covering an expansion joint between a first surface and a second surface of a structure, the cover comprising:

a first plate configured to be rotatably secured to the first surface by a hinge assembly which includes a hinge and a face seal for covering the hinge;

a housing configured to be fixedly secured to the second surface; and a second plate configured to be rotatably secured to the first plate and operable to slide within the housing.

2. An expansion joint cover for covering an expansion joint between a first surface and a second surface of a structure, the cover comprising:

a first plate configured to be rotatably secured to the first surface by a hinge assembly which includes a hinge, a face seal for covering the hinge, and a surface bracket configured to be secured to the first surface and to support the face seal;

a housing configured to be fixedly secured to the second surface; and a second plate configured to be rotatably secured to the first plate and operable to slide within the housing.

3. An expansion joint cover for covering an expansion joint between a first surface and a second surface of a structure, the cover comprising:

a first plate configured to be rotatably secured to the first surface by a hinge assembly which includes a hinge, a face seal for covering the hinge, and a plate bracket configured to be secured to the first plate and to support the face seal;

a housing configured to be fixedly secured to the second surface; and a second plate configured to be rotatably secured to the first plate and operable to slide within the housing.

4. An expansion joint cover for covering an expansion joint between a first surface and a second surface of a structure, the cover comprising:

a first plate configured to be rotatably secured to the first surface;

a housing configured to be fixedly secured to the second surface; and a second plate configured to be rotatably secured to the first plate by a hinge assembly which includes a hinge and a face seal for covering the hinge, wherein the second plate is operable to slide within the housing.

5. An expansion joint cover for covering an expansion joint between a first surface and a second surface of a structure, the cover comprising:

a first plate configured to be rotatably secured to the first surface;

a housing configured to be fixedly secured to the second surface; and a second plate configured to be rotatably secured to the first plate by a hinge assembly which includes a hinge, a face seal for covering the hinge, and a plate bracket configured to be secured to the first plate and to support the face seal, wherein the second plate is operable to slide within the housing.

6. An expansion joint cover for covering an expansion joint between a first surface and a second surface of a structure, the cover comprising:

a first plate configured to be rotatably secured to the first surface;

a housing configured to be fixedly secured to the second surface; and a second plate configured to be rotatably secured to the first plate by a hinge assembly which includes a hinge, a face seal for covering the hinge, and a plate bracket configured to be secured to the second plate and to support the face seal, wherein the second plate is operable to slide within the housing.

7. An expansion joint cover for covering an expansion joint between a first surface and a second surface of a structure, the cover comprising:

a first plate configured to be rotatably secured to the first surface;

a second plate configured to be rotatably secured to the first plate; and a housing configured to be fixedly secured to the second surface, wherein the second plate is operable to slide within the housing and the housing includes a front plate which is rotatable during installation to allow a portion of the second plate to be placed within the housing.

8. An expansion joint cover for covering for covering an expansion joint between a first surface and a second surface of a structure, the cover comprising:

a first plate configured to be rotatably secured to the first surface;

a second plate configured to be rotatably secured to the first plate; and a housing configured to be fixedly secured to the second surface, wherein the second plate is operable to slide within the housing and the housing includes front plate which is rotatable during installation to allow a portion of the second plate to be placed within the housing, and a hinge configured to rotatably secure the front plate to a rear plate.

9. An expansion joint cover for covering an expansion joint between a first surface and a second surface of a structure, the cover comprising:

a first plate configured to be rotatably secured to the first surface;

a second plate configured to be rotatably secured to the first plate; and a housing configured to be fixedly secured to the second surface, wherein the second plate is operable to slide within the housing and the housing includes front plate which is rotatable during installation to allow a portion of the second plate to be placed within the housing, a hinge configured to rotatably secure the front plate to a rear plate, and tension block configured to be secured to the rear plate.

10. An expansion joint cover for covering an expansion joint between a first surface and a second surface of a structure, the cover comprising:

a first plate configured to be rotatably secured to the first surface;

a second plate configured to be rotatably secured to the first plate; and a housing configured to be fixedly secured to the second surface, wherein the second plate is operable to slide within the housing and the housing includes front plate which is rotatable during installation to allow a portion of the second plate to be placed within the housing, a hinge configured to rotatably secure the front plate to a rear plate, a tension block configured to be secured to the rear plate, and a treaded fastener for fixedly securing the front plate to the tension block such that the front plate is held substantially parallel to the rear plate.

11. An expansion joint cover for covering an expansion joint between a first surface and a second surface of a structure, the cover comprising:

a first plate configured to be rotatably secured to the first surface by a hinge assembly which includes a hinge and a face seal for covering the hinge;

a housing configured to be fixedly secured to the second surface;

a second plate configured to be rotatably secured to the first plate and operable to slide within the housing; and at least two low friction gaskets which allow the second plate to slide within the housing.

12. An expansion joint cover for covering an expansion joint between a first surface and a second surface of a structure, the cover comprising:

a first plate configured to be rotatably secured to the first surface by a hinge assembly which includes a hinge and a face seal for covering the hinge;

a housing configured to be fixedly secured to the second surface, wherein the housing includes a front plate secured to a rear plate by a bracket; and a second plate configured to be rotatably secured to the first plate and operable to slide within the housing.

13. An expansion joint cover for covering an expansion joint between a first surface and a second surface of a structure, the cover comprising:

a first hinge configured to be secured to the first surface;

a first plate configured to be secured to the first hinge;

a second hinge configured to be secured to the first plate;

a housing configured to be fixedly secured to the second surface, the housing including front plate with a front low friction gasket, a rear plate with a rear low friction gasket, a third hinge configured to rotatably secure the front plate to the rear plate, a tension block configured to be secured to the rear plate, and a treaded fastener for fixedly securing the front plate to the tension block such that the front plate is held substantially parallel to the rear plate; and a second plate configured to be secured to the second hinge and operable to slide between the low friction gaskets and substantially parallel to the front plate and the rear plate.

14. The expansion joint cover as set forth in claim 13, wherein the cover includes a face seal for covering the first hinge.

15. The expansion joint cover as set forth in claim 13, wherein the cover includes a face seal for covering the second hinge.

16. The expansion joint cover as set forth in claim 13, wherein the cover includes a face seal for covering the third hinge.

17. The expansion joint cover as set forth in claim 13, wherein the second plate includes a positioner that aligns the second plate within the housing.

18. An expansion joint cover for covering an expansion joint between a first surface and a second surface of a structure, the cover comprising:

a first hinge assembly configured to be secured to the first surface including first hinge, a first face seal covering the first hinge, a first surface bracket configured to be secured to the first surface and to support the first face seal, and a first plate bracket configured to be secured to the first hinge and to support the first face seal;

a first plate configured to be secured to the first hinge by a first threaded fastener through the first plate bracket;

a second hinge assembly configured to be secured to the first plate including second hinge, a second face seal covering the second hinge, a second plate bracket configured to be secured to the first plate and to support the second face seal, and a third plate bracket configured to be secured to the second hinge and to support the second face seal;

a housing configured to be fixedly secured to the second surface, the housing including front plate with a front low friction gasket, a rear plate with a rear low friction gasket, a third hinge configured to rotatably secure the front plate to the rear plate, a tension block configured to be secured to the rear plate, and a threaded fastener for fixedly securing the front plate to the tension block such that the front plate is held substantially parallel to the rear plate; and a second plate configured to be secured to the second hinge and operable to slide between the low friction gaskets and substantially parallel to the front plate and the rear plate.

* * * * *